United States Patent [19]

Henning et al.

[11] 4,349,165

[45] Sep. 14, 1982

[54] COIL CARRIER WITH CARRIER ELEMENTS EXTENDING PARALLEL TO ITS AXIS

[75] Inventors: Walter Henning, Alsdorf; Heinz-Peter Illig, Ubach-Palenberg, both of Fed. Rep. of Germany

[73] Assignee: Jos. Zimmerman, Aachen, Fed. Rep. of Germany

[21] Appl. No.: 193,943

[22] PCT Filed: Jun. 22, 1979

[86] PCT No.: PCT/DE79/00059

§ 371 Date: Feb. 27, 1980

§ 102(e) Date: Feb. 25, 1980

[87] PCT Pub. No.: WO80/00147

PCT Pub. Date: Feb. 7, 1980

[30] Foreign Application Priority Data

Jun. 27, 1978 [DE] Fed. Rep. of Germany ..... 2828121

[51] Int. Cl.[3] ..... B65H 75/20

[52] U.S. Cl. ..... 242/118.11; 242/129; 68/198

[58] Field of Search ..... 242/118.1, 118.11, 118.2, 242/129; 68/189, 198

[56] References Cited

U.S. PATENT DOCUMENTS

| | | | |
|---|---|---|---|
| 3,718,287 | 2/1973 | Sottosanti | 242/118.11 |
| 4,078,740 | 3/1978 | Hahm et al. | 242/118.11 |
| 4,180,219 | 12/1979 | Becker et al. | 242/118.1 |

FOREIGN PATENT DOCUMENTS

| | | | |
|---|---|---|---|
| 610248 | 9/1926 | France | 242/118.1 |
| 1085398 | 2/1955 | France | 242/118.1 |

*Primary Examiner*—Leonard D. Christian
*Attorney, Agent, or Firm*—Finnegan, Henderson, Farabow, Garrett & Dunner

[57] ABSTRACT

A coil carrier for packages of thread or yarn comprises interconnected carrier elements extending parallel to its axis. The individual carrier elements (1; 25; 40) are circumferentially compressible and shape-retaining coupling members (4, 7; 10; 15; 29, 30 to 33) are provided between adjacent carrier elements. The gap between two adjacent carrier elements is larger than the dimension of a carrier element in the circumferential direction.

13 Claims, 8 Drawing Figures

COIL CARRIER WITH CARRIER ELEMENTS EXTENDING PARALLEL TO ITS AXIS

The invention relates to a coil carrier with interconnected carrier elements extending parallel to its axis and projecting radially outwardly into a common cylindrical surface.

Coil carriers for thread and yarn packages are already known that can be compressed or telescoped in the axial direction and are used for the wet treatment of thread and yarn packages, for example during dyeing.

A known coil carrier of this kind consists of two sleeve portions of equal diameter and comprise carrier elements which extend parallel to the axis and are equally spaced circumferentially, the carrier elements of the one sleeve portion engaging in gaps between the carrier elements of the other sleeve portion.

A coil carrier is also known which is not compressible itself but co-operates with like coil carriers in axial alignment. This coil carrier comprises carrier elements which extend parallel to its axis and are secured to an end ring. Between each two carrier elements, the end ring is provided with an aperture into which a carrier element of an adjacent coil carrier can be introduced. Consequently, it is also possible in this known coil carrier to reduce the original axial length by compression.

Further, a coil carrier is known comprising an axially and radially flexible wall formed by elastically and/or plastically flexible elements and rigid longitudinal webs which connect these elements and extend axially. The flexible elements are axially spaced rings and the axially successive longitudinal webs connecting these rings are circumferentially offset. This means that when the known coil carrier is axially compressed, its wall will necessarily assume a smaller diameter.

The production of such a known coil carrier calls for a relatively expensive mould and in addition it necessarily results in an interrelationship between axial compression and a reduction in diameter, which is now always desired. Also, internesting of these coil carriers is not possible to reduce their volume for transport purposes.

The problem of the present invention is to construct a coil carrier of the aforementioned kind so that, in conjunction with like coil carriers, it permits axial compression of the thread or yarn packages and also a reduction in diameter, both effects not being necessarily interrelated. This is to be achieved with a simple construction and the possibility of troublefree production of the coil carrier.

This problem is solved according to the invention in that the individual carrier elements are circumferentially compressible, that substantially shape-retaining coupling members are provided between two adjacent carrier elements, and that the gap between two adjacent carrier elements is larger than the dimension of a carrier element in the circumferential direction. A plurality of coil carriers of this kind can be partially telescoped in order thereby to reduce the axial length of thread and yarn packages. Compression of the carrier elements in the circumferential direction shortens the circumference and thus produces a reduction in diameter. Accordingly, a simply constructed coil carrier of this kind results in a carrier which is axially as well as radially compressible.

The invention provides for each carrier element to have a radially inwardly open V-shaped cross-section with limbs compressible towards each other. However, other cross-sectional shapes are also possible, for example U-shaped as well as arcuate.

According to a further embodiment of the invention, provision is made for each carrier element to be formed by two parallel limbs interconnected near the ends of the coil carrier. In both embodiments of the carrier elements, the sections are simple and compressible in the circumferential direction.

The invention further provides for the inner faces of the carrier elements to lie on a cylindrical surface at least in the zone projecting beyond the outermost coupling member, the diameter of the cylindrical surface being equal to or larger than the diameter on which the outer faces of this coupling member are disposed. It follows that the carrier elements of one coil carrier can engage over the coupling member or members of another coil carrier. The dimensions can be chosen so that the inner faces of the carrier elements are guided on the outer faces of the coupling members. The coupling members can also be used to limit the maximum extent to which two adjacent coil carriers can be pushed into one another.

Finally, the invention provides for the coil carrier to comprise at least one guide ring on which there are supported flexible bending elements which are connected to the coupling members. In this way one obtains positive guiding of the coil carrier as well as a reliable support for the carrier elements.

Further features of the invention, which are the subject of subsidiary claims, will follow from the following description of a few embodiments of the invention with reference to drawings, wherein:

Figure 1:
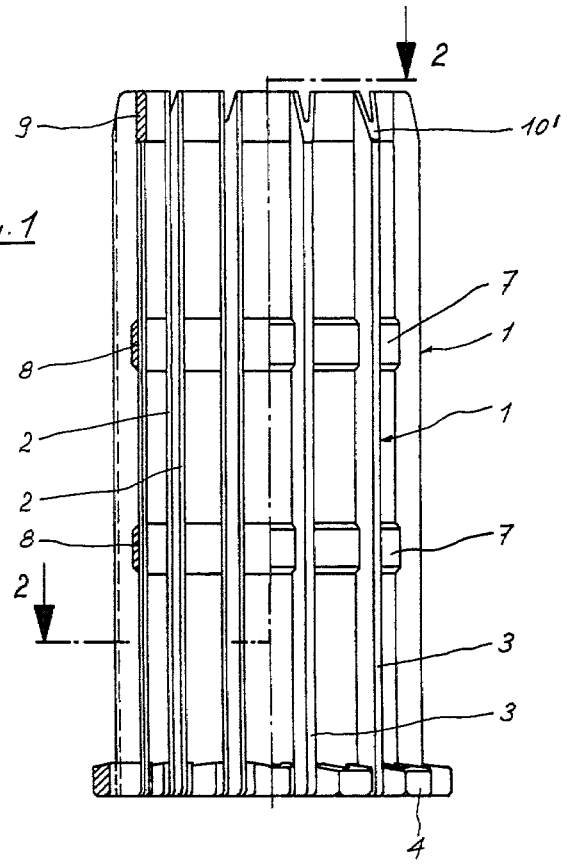
FIG. 1 is a part-sectional elevation of a first embodiment of the coil carrier according to the invention taken on the line 1—1 in FIG. 2.
Figure 2:
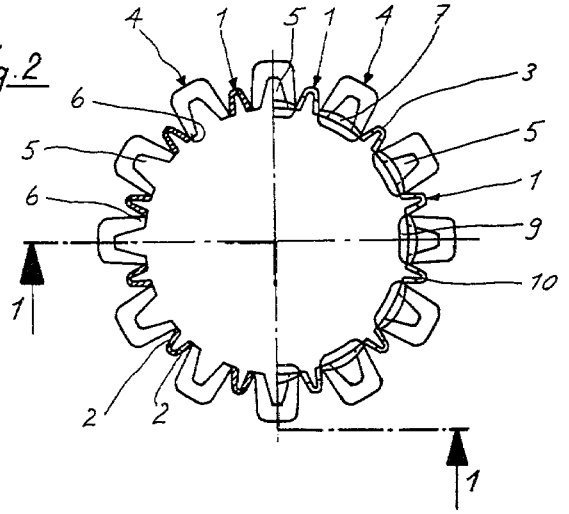
FIG. 2 is a section on the line 2—2 in FIG. 1.

The FIGS. 1 and 2 embodiment of the coil carrier according to the invention comprises carrier elements 1 extending parallel to the axis of the coil carrier. Each carrier element 1 has a V-shaped cross-section which is open radially inwardly. It is thus formed by two limbs 2 which can be compressed towards each other. The carrier elements 1 have radially outwardly disposed vertex faces 3 lying on a common cylindrical enveloping surface.

All the carrier elements 1 of the coil carrier are coupled by connecting elements 4 at its one end, each connecting element being disposed between two carrier elements 1. These connecting elements 4 are substantially shape-retaining. They each have a radially inwardly open aperture 5 which is slightly larger than the dimensions of a carrier element 1 in the uncompressed position. It follows that the apertures 5 preferably likewise have a V-shaped construction. The connecting elements 4 project radially outwardly beyond the common enveloping surface of the carrier elements 1. At their radially inner peripheral edges 6, they are each hinged to one carrier element 1 so that the position of the limb 2 of such a carrier element 1 relatively to the associated connecting element 4 can be readily changed by compressing the carrier element 1.

As will be evident particularly from FIG. 1, the carrier elements 1 are, in addition to the connecting elements 4, also connected by two ring-like coupling elements 7. These elements are composed of ring segments each extending between the confronting limbs 2 of adjacent carrier elements 1. The inner faces 8 of these ring-like coupling elements 7 are disposed substantially on the same cylindrical surface as are the inner faces of the carrier elements 1, so that a ring-like coupling element 7 can be used as a maximum limit for telescoping two like coil carriers.

The FIG. 1 embodiment also provides for a further ring-like coupling element 9 which is disposed near the end of the coil carrier remote from the connecting elements 4 and provides additional stiffening. This coupling element 9 is likewise composed of ring segments but these are so arranged that the outer diameter of this coupling element 9 is equal to or smaller than the diameter of the cylindrical surface on which the inner faces of the carrier elements 1 are disposed. In the vicinity of the coupling element 9, the radially outwardly disposed ends have a bevel 10'.

Two axially aligned coil carriers according to the FIGS. 1 and 2 embodiment can be partially telescoped by introducing the carrier elements 1 of the coil carrier in the apertures 5 of the connecting elements 4 of another coil carrier. The one coil carrier can then be pushed into the other until the front ends of the carrier elements 1 meet an abutment, particularly a coupling element 7.

If, now, radially effective pressure is exerted on the coil carrier, the limbs 2 of each carrier element 1 are pressed towards each other. The various connecting and coupling elements do not participate in this deformation. Nor does this deformation affect the relative axial displaceability of two coil carriers.

Figure 3:
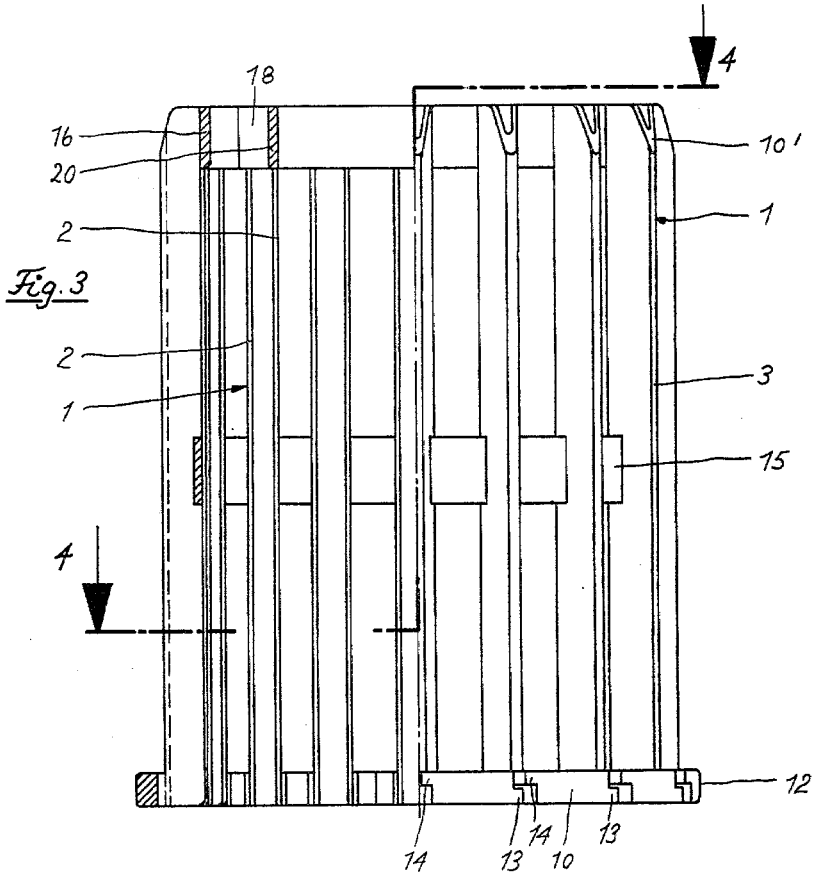
FIG. 3 is a part-sectional elevation of a second embodiment of the coil carrier according to the invention taken on the line 3—3 in FIG. 4.
Figure 4:
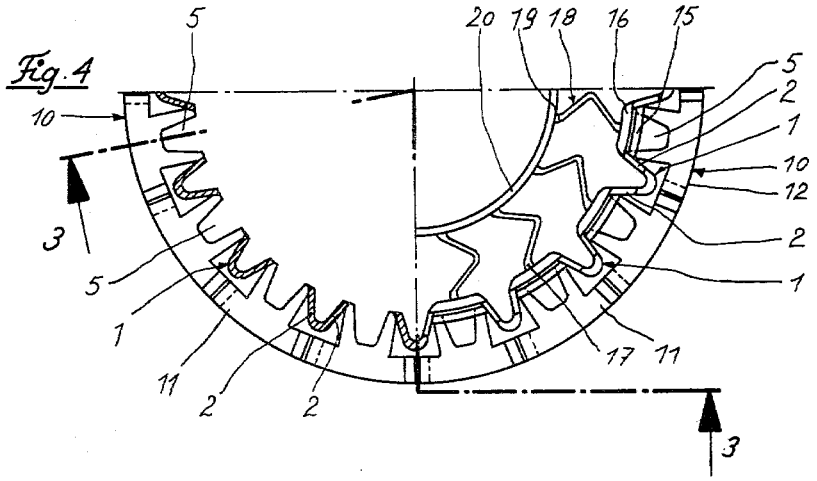
FIG. 4 is a section on the line 4—4 in FIG. 3.

The embodiment of the coil carrier according to the invention as shown in FIGS. 3 and 4 also comprises carrier elements 1 each having two limbs 2 as was described in conjunction with the FIGS. 1 and 2 embodiment. However, all carrier elements of the coil carrier are coupled at its one end by substantially shape-retaining connecting elements 10, each of which is disposed between two carrier elements 1. As in the case of the connecting elements 4 of the FIGS. 1 and 2 embodiment, these connecting elements 10 have an aperture 5 which is slightly larger than the dimensions of a carrier element 1 in the uncompressed condition.

The connecting elements 10 differ from the previously described embodiment in that they each have a radially outwardly disposed section 11 with an arcuate outer face 12. These outer faces 12 of the connecting elements 10 lie on a common cylindrical surface of which the axis coincides with that of the coil carrier. As shown particularly on the right-hand side of FIG. 3, each connecting element 10 forms a projection 13 at its one end in the vicinity of its section 11 in the circumferential direction and at its other end a projection 14 which is offset from the projection 13. These projections 13, 14 of one connecting element 10 co-operate with correspondingly formed projections 13, 14 of the adjacent connecting elements so that the projections 13, 14 of adjacent connecting elements 10 will then engage over each other. In this way the connecting elements 10 together define a continuous cylindrical surface by which the coil carrier can be driven. The overlapping of the projections 13, 14 of adjacent connecting elements 10 maintains a continuous engaging surface even when the coil carrier is radially compressed.

The coil carrier of FIGS. 3 and 4 comprises a ring-like coupling element 15 which is composed of ring segments each extending between the limbs 2 of adjacent carrier elements 1.

Finally, near the end of the coil carrier remote from the connecting elements 10 there is a further coupling element 16 which, as already described in conjunction with FIGS. 1 and 2, is composed of ring segments. Secured to each ring segment of the coupling element 16 there is an edge 17 of a V-shaped bending element 18 of which the other edge 19 is secured to a central guide ring 20 which is concentric with the axis of the coil carrier as well as the coupling element 16. The guide ring 20 serves for the exact guiding of the entire coil carrier and also for supporting the segments of the coupling element 16.

If, now, radial pressure is exerted on this coil carrier, the limbs 2 of each carrier element 1 are pushed towards each other. The adjacent connecting elements 10 are relatively displaced, the projections 13, 14 of these connecting elements 10 moving relatively to each other and thereby maintaining a continuous rolling surface. At the same time, the bending elements 18 are radially compressed. The coupling elements 15 and 16 do not change their shape during this deformation of the entire coil carrier.

Figure 5:
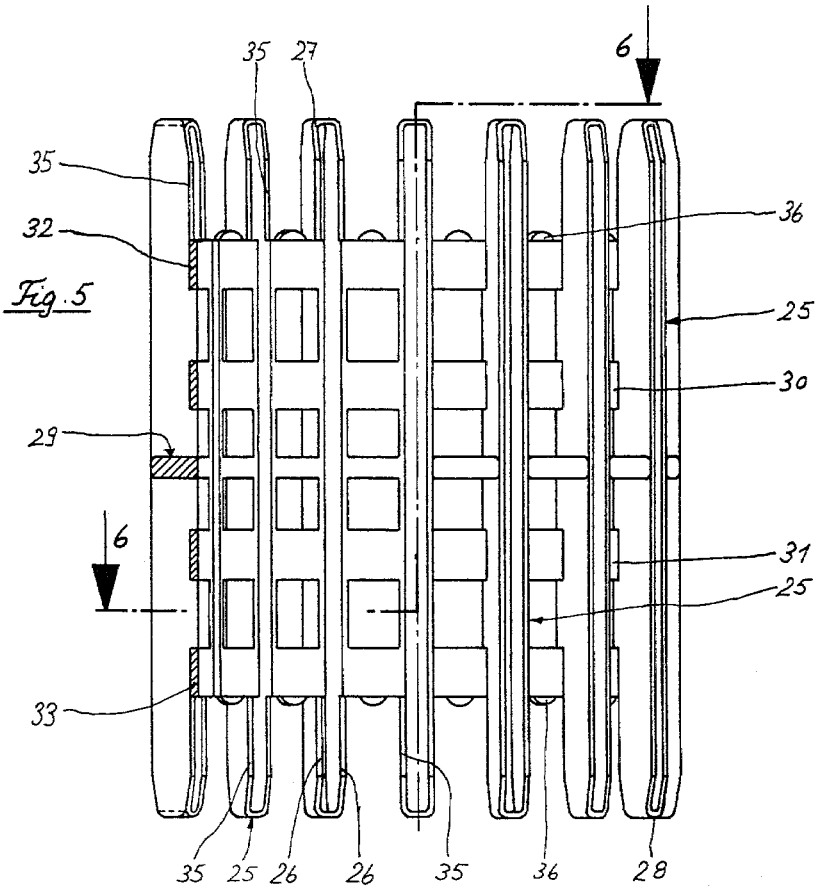
FIG. 5 is a part-sectional elevation of a third embodiment of the coil carrier according to the invention taken on the line 5—5 in FIG. 6.
Figure 6:
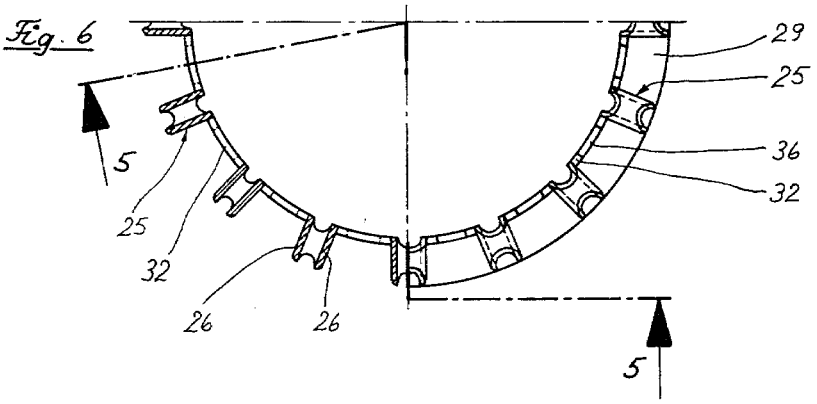
FIG. 6 is a section on the line 6—6 in FIG. 5.

The embodiment of FIGS. 5 and 6 comprises a row of carrier elements 25 which extend parallel to the axis of the coil carrier and are each formed of two parallel web-like limbs 26. At both ends of the coil carrier, the two limbs 26 of each carrier element 25 are securely connected to each other.

As will be particularly evident from FIG. 5, the carrier elements 25 are provided with bevels 27, 28 at both ends and radially inwardly as well as radially outwardly.

In this embodiment, a ring-like supporting element 29 is preferably provided midlength of the coil carrier. It is composed of a row of ring segments which each connect two limbs 26 of adjacent carrier elements 25. The radial extent of the ring segments substantially corresponds to that of the limbs 26. The coil carrier of this embodiment also comprises a few ring-like coupling elements 30, 31, 32 and 33.

These elements are likewise composed of segments which each connect two confronting limbs 26 of adjacent carrier elements 25. The supporting element 29 and the coupling elements 30 to 33 provide the required stiffening of the coil carrier.

At both end regions of the coil carrier that project beyond the respective end of the adjacent coupling elements 30, 33, the carrier elements 25 comprise inner faces 35 which lie on a cylindrical surface of which the diameter is equal to or larger than the outer diameter of the coupling elements 30 to 33 as referred to the axis of the coil carrier. Two coil carriers according to this embodiment of the invention can therefore likewise be partially telescoped after axial alignment, the carrier elements 25 of the one coil carrier coming to lie between the carrier elements of another coil carrier. The free ends of the coil carriers will in that case engage over the closest adjacent coupling elements 32, 33.

The coupling elements 32, 33 adjacent the respective end of the coil carrier are provided with spacer cams 36 at the face confronting the end of the coil carrier. These spacer cams 36 ensure that when two coil carriers are telescoped space will then remain between the adjacent coupling elements of two coil carriers to permit the passage of a dyeing liquor and that two planar faces do not come to lie on each other, which might make it difficult to separate these coil carriers.

If radially effective pressure is exerted on this coil carrier, the limbs 26 of each carrier element 25 are displaced towards each other whereby the circumference is shortened and the diameter is reduced. In this embodiment, the relative displaceability of two interengaging coil carriers is likewise independent of any radial compression.

Figure 7:
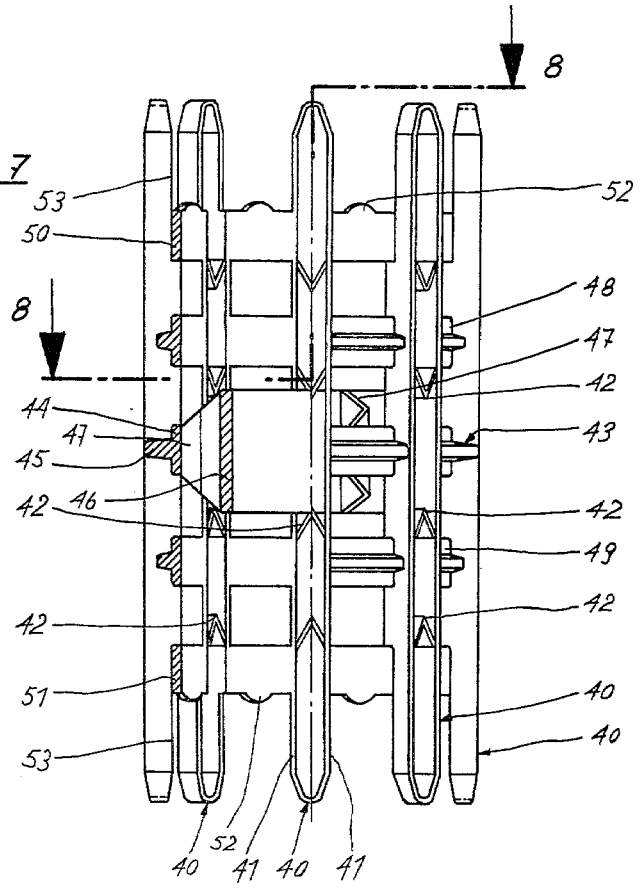
FIG. 7 is a part-sectional elevation of a fourth embodiment of the coil carrier according to the invention taken on the line 7—7 in FIG. 8.
Figure 8:
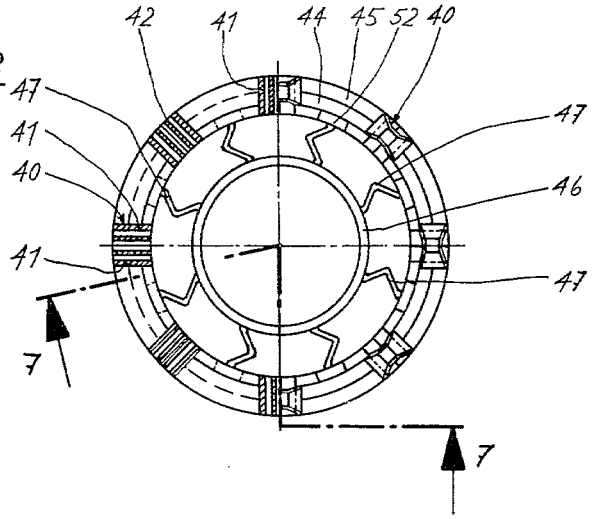
FIG. 8 is a section on the line 8—8 in FIG. 7.

Referring to FIGS. 7 and 8, a further embodiment of the coil carrier according to the invention will now be described which comprises a row of carrier elements 40 extending parallel to the axis of the coil carrier and each formed by two parallel web-like limbs 41. At the two ends of the coil carrier, the two limbs 41 of a carrier element 40 are securely interconnected in V-formation, the end zones of each carrier element 40 being tapered. Between the limbs 41 of each carrier element 40 there is a row of bending elements 42 which are V-shaped and support the two limbs 41 with respect to each other. In the illustrated embodiment, four such bending elements 42 are provided which project into the common cylindrical surface defined by the outer faces of the carrier elements 40. However, the number as well as the construction of these bending elements can be adapted to suit particular requirements.

In this embodiment a ring-like supporting element 43 is again provided preferably midlength of the coil carrier; it has a substantially rectangular base 44 in cross-section and, extending centrally therefrom, a radially outwardly projecting web 45 which projects into the cylindrical surface common to all the outer faces of the carrier elements 40. This supporting element 43 likewise extends only between the confronting limbs 41 of adjacent carrier elements 40.

In this embodiment, the webs 45 of the supporting element 43, the limbs 41 and the bending elements 42 form a continuous cylindrical rolling surface for a roller-like driving element.

Disposed concentrically to the ring-like supporting element 43 and radially inwardly thereof there is a guide ring 46 having a longer axial extent than that of the base 44 of the supporting element 43. As is shown in FIG. 7, the supporting element 43 as well as the guide ring 46 are symmetrical to a common plane extending normal to the axis of the coil carrier.

A bending web 47 is disposed between each base of a segment of the supporting element 43 and the outer face of the guide ring 46. The web is V-shaped as viewed axially of the coil carrier (FIG. 8). The apex surface of this V-shaped bending web 47 extends substantially parallel to the axis of the coil carrier. The axial extent of the bending web 47 increases radially inwardly starting from the base 44 up to the outer face of the guide ring 46.

Ring-like coupling elements 48, 49 of T shape in cross-section are provided at both sides of the supporting element 43 and at a spacing therefrom. Their inner faces lie on a cylindrical surface common to the inner face of the base 44 of the supporting element 43.

Finally, a further coupling element 50, 51 of rectangular cross-section is provided near the ends of the coil carrier. These two coupling elements 50, 51 likewise lie on the same cylindrical surface as do the inner faces of the coupling elements 48 and 49 as well as of the supporting element 43. At the surface facing the end of the coil carrier, the coupling elements 50, 51 are provided with spacer cams 52 which have already been described in relation to the FIGS. 5 and 6 embodiment. In both end regions of the coil carrier which extend beyond the respective end of the adjacent coupling element 50, 51, the supporting elements 40 have inner faces 53 lying on a cylindrical surface with a diameter equal to or larger than the outer diameter of the coupling elements 50, 51 referred to the axis of the coil carrier. Thus, two coil carriers of this embodiment of the invention can likewise be axially aligned and pushed into each other, the carrier elements 40 of the one coil carrier coming to lie between the carrier elements of the other coil carrier. The free ends of the coil carriers will then engage over the coupling elements 50, 51 which are closest to the respective end.

If a radially effective pressure is exerted on this coil carrier, the limbs 41 of each carrier element 40 are displaced towards each other, which results in shortening of the circumference and thus a reduction in diameter so that the diameter of the coil carrier is shortened in this manner. During this compression in the radial direction, the bending webs 47 disposed between the supporting element 43 and guide ring 46 should also be compressed.

In all of the embodiments described, a starting ring (not shown) can be placed on the coil carrier. By reason of radially inwardly open grooves, this ring permits radially inwardly directed displacement of the carrier elements and thereby maintains a continuous rolling surface. Such a starting ring, which must exceed the largest diameter of the coil carrier, permits the coil carrier to be driven by a roller-like body of rotation, provides considerable stabilization and markedly enhances troublefree uncoiling because this ring excludes snagging.

The coil carriers according to the described embodiments are desirably produced from plastics material but could also be made from any other suitable material.

We claim:

1. A coil carrier comprising interconnected circumferentially compressible carrier elements extending parallel to the carrier axis, said carrier elements projecting radially outwardly and forming a common cylindrical surface, and axially spaced shape-retaining coupling members (4, 7; 10; 15; 29, 30 to 33; 48 to 51) disposed between and interconnecting respective pairs of circumferentially adjacent carrier elements (1; 25; 40), said coupling members securing said carrier elements in spaced relationship while permitting uniform circumferential compression of said coil carrier throughout its axial length, and wherein the gap between each two adjacent carrier elements is larger than the dimensions of a carrier element in the circumferential direction, said carrier being axially partly insertable into a coil carrier of like construction.

2. A coil carrier according to claim 1, characterised in that each carrier element (1) has a radially inwardly open V-shaped cross-section defined by limbs (2) compressible towards each other.

3. A coil carrier according to claim 1 or claim 2, characterised in that at least some of the coupling members comprise connecting elements (4; 10) provided at one end of the coil carrier, each connecting element having a radially inwardly open aperture (5) of a size corresponding at least to the maximum cross-sectional dimension of said carrier elements (1) said connecting elements being hinged at their radially inward peripheral edges to the carrier elements (1).

4. A coil carrier according to claim 3, characterised in that the connecting elements (10) comprise circumferentially overlapping projections (13, 14) and form a continuous cylindrical outer surface.

5. A coil carrier according to claim 1, characterised in that each carrier element (25; 40) comprises two parallel limbs (26; 41) interconnected to each other near the ends of the coil carrier.

6. A coil carrier according to claim 5, characterised in that bending webs (42) are provided between the limbs (26; 41) of said carrier elements (25).

7. A coil carrier according to claim 6, characterised in that the bending webs (42) are V-shaped.

8. A coil carrier according to any one of claims 2, 5, 6, or 7, characterised in that said coupling members (7, 9; 15, 16; 29–33; 43, 48–51) comprise ring segments distributed over the length of the coil carrier and disposed in planes normal to the coil carrier axis, each ring segment being connected to the limbs (2, 26; 41) of adjacent carrier elements (1; 25; 40).

9. A coil carrier according to claim 8, wherein the radially outer faces of said ring segments define a cylindrical surface and the inner faces (53) of the carrier elements (25; 40) lie on another cylindrical surface which, at least in the zone projecting beyond the endmost coupling member (50, 51), has a diameter equal to or larger than the diameter of the cylindrical surface defined by the outer faces of the coupling members.

10. A coil carrier according to claim 8, characterised in that the carrier elements (1) are provided at one end thereof with a coupling member (9; 16) the outer diameter of which is equal to or larger than the diameter of the cylindrical surface on which the inner faces of the carrier elements are disposed.

11. A coil carrier according to claim 9, further comprising at least one guide ring (20; 46) and flexible bending elements (18, 47) supported on said guide ring and connected to the coupling members (7, 9; 15, 16; 29–33; 48–51).

12. A coil carrier according to claim 8, characterised in that at least the coupling members (32, 33; 50, 51) closest to one end of the coil carrier are each provided with a spacer cam (36; 52) at its faces confronting said end of the coil carrier.

13. A coil carrier according to claim 9, characterised in that at least the coupling members closest to one end of the coil carrier are each provided with a spacer cam at its face confronting said end of the coil carrier.

* * * * *